US006363982B1

(12) United States Patent
Nixon, Jr.

(10) Patent No.: US 6,363,982 B1
(45) Date of Patent: Apr. 2, 2002

(54) SINGLE OR MULTIPLE MORTISING, TENONING AND DOVETAIL WOODWORKING JIG

(76) Inventor: Elmo D. Nixon, Jr., 2463 Hare Hollow Rd., Granstville, MD (US) 21536

( * ) Notice: Subject to any disclaimer, the term of this patent is extended or adjusted under 35 U.S.C. 154(b) by 0 days.

(21) Appl. No.: 09/553,342

(22) Filed: Apr. 21, 2000

(51) Int. Cl.[7] ..... B27C 5/00

(52) U.S. Cl. ..... 144/144.51; 144/144.1; 144/372

(58) Field of Search ..... 144/137, 144.1, 144/144.52, 253.5, 372, 144.51; 409/108, 110, 125, 130

(56) References Cited

U.S. PATENT DOCUMENTS 5,052,454 A * 10/1991 Meinhardt ..... 144/144.52
5,458,171 A * 10/1995 Wand ..... 144/144.1
5,893,402 A * 4/1999 Darling ..... 144/144.52

* cited by examiner

*Primary Examiner*—W Donald Bray
(74) *Attorney, Agent, or Firm*—Dwight G. Diehl, Esquire

(57) ABSTRACT

A double mortising, tenoning and dovetailing wood working machine including a base member, a sliding member and locking members. The base member is mounted on a table. The sliding member and locking members serve to precisely locate the base member relative to a piece of wood stock. The base member can be located over a piece of wood stock, locked into place and have a tenon or tail cut on the stock. The base member can then be moved horizontally over the stock, locked into position and have a second tenon or tail cut on the stock. The stock is then removed and replaced with another piece of wood stock to receive the mortise or socket joints. Through the use of the locking members and the slide member the base member can be located over the stock in the exact location needed to cut the mortise or socket joints to allow for a precise double mortise-tenon or dovetail joint.

5 Claims, 4 Drawing Sheets

SINGLE OR MULTIPLE MORTISING, TENONING AND DOVETAIL WOODWORKING JIG

BACKGROUND OF THE INVENTION

The present invention involves tenon and mortise joints, which can quickly and easily be made. The present device is capable of making double tenons and mortises with exact precision time and time again. The present invention allows a double tenon to be made and repeated on numerous pieces of material with an exact duplication. Also, the double mortise can be made to match exactly the double tenon having been made previously. The conversion of the machine from tenon to mortise can be easily done in a relatively quick changeover time, thus allowing the carpenter to move back and forth between mortise and tenons and change the sizes of each with relative ease.

PRIOR ART

Existing on the market today are numerous tenoning machines that allow one to make single tenons and mortises and to convert from one to the other relatively quickly. The closest prior art of record would appear to be U.S. Pat. No. 4,593,735 and U.S. Pat. No. 4,909,292; however, the instant device has numerous advantages over the devices disclosed in those patents. Namely, the present device is less complex and smaller in design. Further, the prior art fails to teach and/or disclose the manufacturing or making of double tenon and mortise joints.

BRIEF DESCRIPTIONS OF THE DRAWINGS

DETAILED DESCRIPTION

Figure 1:
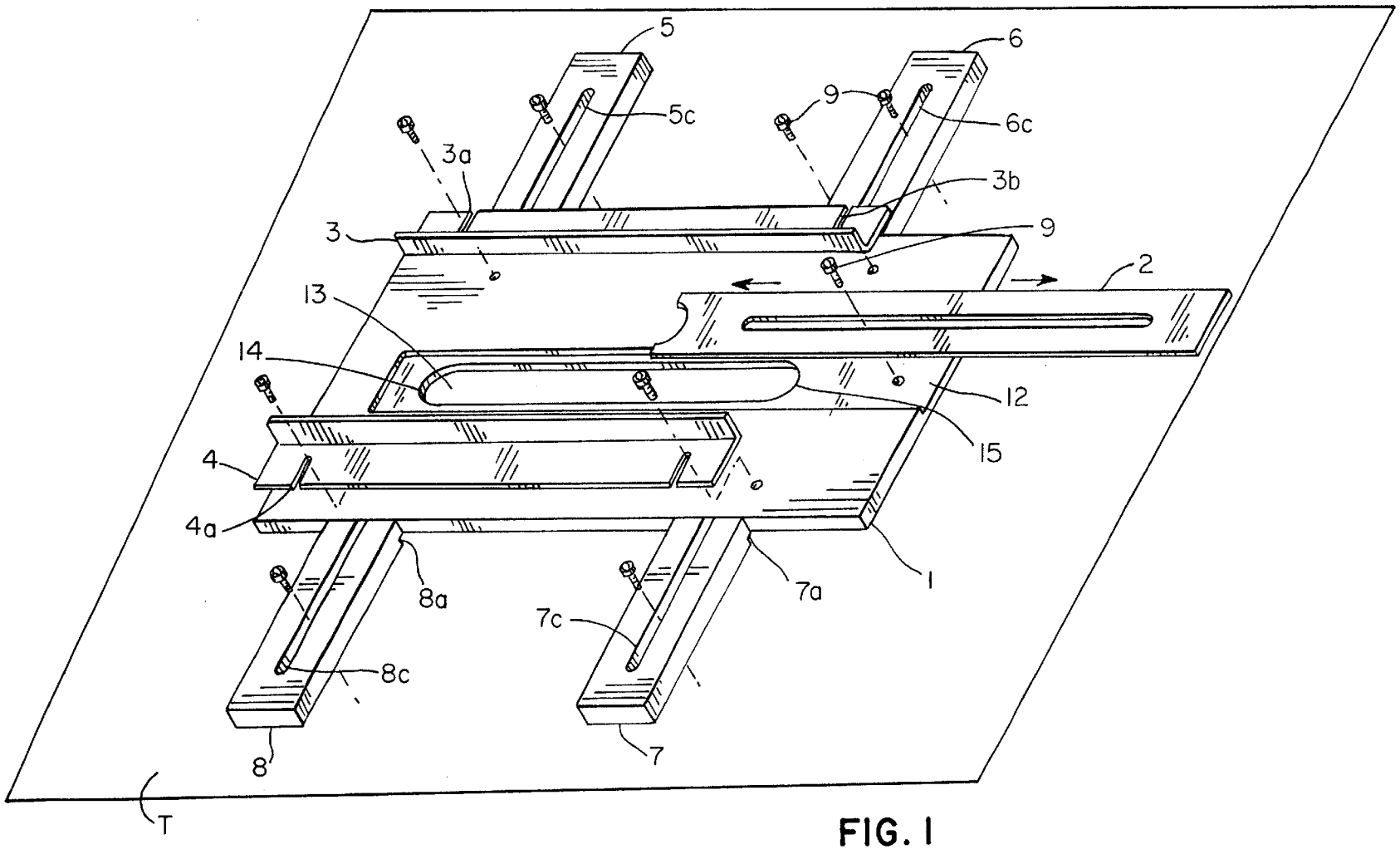
FIG. 1 is an overview of the invention.

The present device is constructed to be mounted on a table T. The present invention is comprised of a main frame or base 1, a slide 2, guide rails 3 and 4, position locks 5, 6, 7, and 8, a T slide comprised of a base of slide member 11 and a top adjusting member 10, and numerous threaded screw members 9, attaching the various members together or to the table T.

Figure 5:
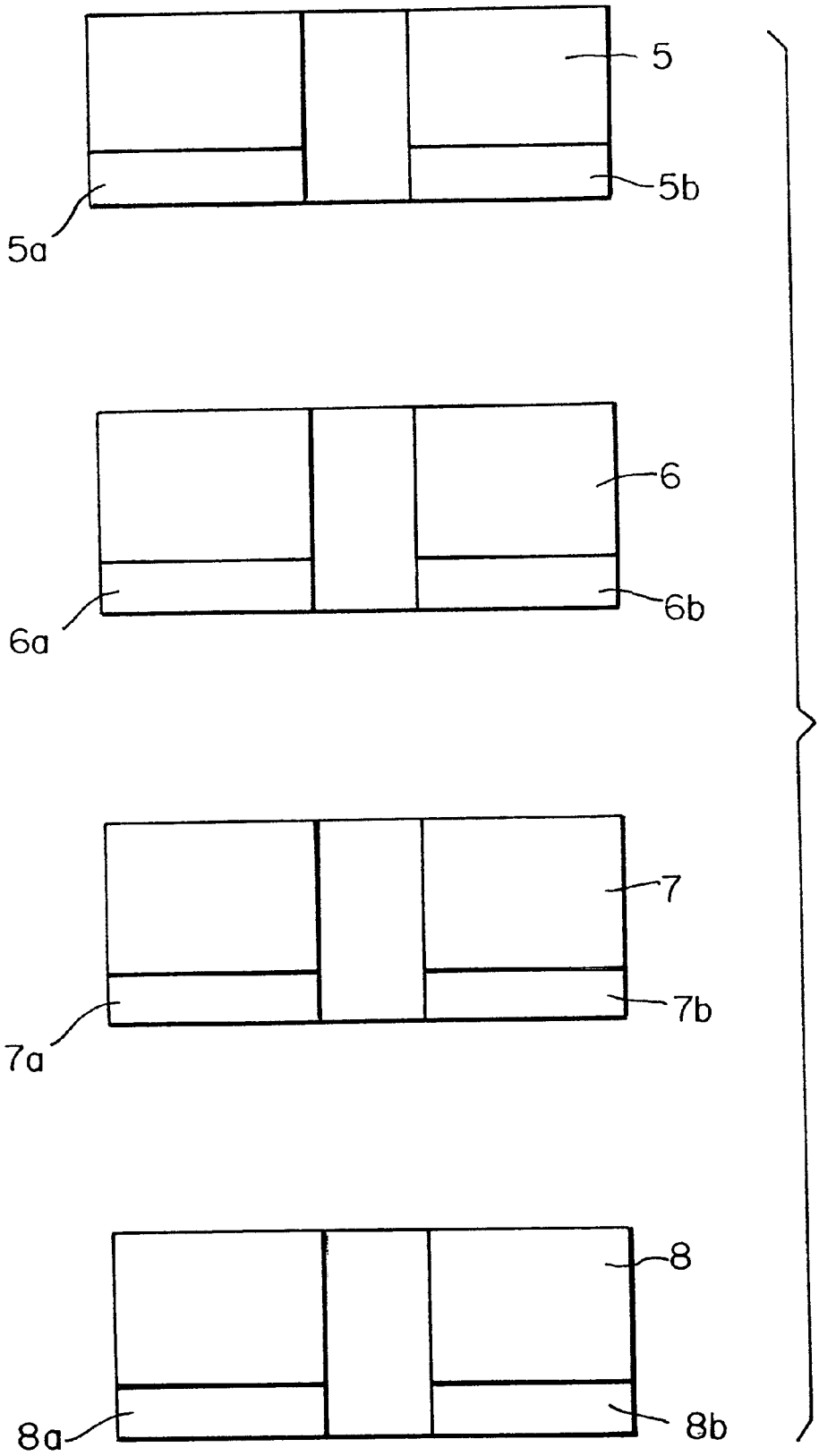
FIG. 5 is an end view of the locking members showing the kerfs.

The main frame or base member 1 has basically a rectangular shaped aperture 13 therein to accommodate the slide member 2 for adjustment of the length of the aperture. The slide member 2 is inserted into a groove 12 located in the base member and extending the length of the aperture 13. Once the slide member 2 is located in the groove 12 of the base member 1 it can be moved longitudinally in or out lengthening or shortening the aperture 13. A locking screw 9 holds the slide member 2 in place once it is adjusted to the desired location. The ends 14 and 15 of aperture 13 are rounded edges to allow a rotor bit to follow in a semi-circular direction once it reaches the ends of the aperture 13. End 14 can be molded into and be of one piece construction with the base member 1 or it can be constructed of a separate piece that can be inserted and removed readily from base member 1. The guide rails 3 and 4 are held in place on the base member 1 by locking screws 9. Two locking screws are used in each guide rail to position them in the appropriate location. The guide rails 3 and 4 contain slots 3*a*, 3*b*, 4*a* and 4*b* respectively. Said slots accept the locking screws 9 which thread into the base member 1 to hold the guide rails in place. The guide rails can be moved toward or away from one another upon the base member 1 to adjust the distance of each from the aperture 13. Use of the guide rails 3 and 4 and the sliding member 2 are to position an ordinary router or other cutting tool over the end of material stock that is to be used in the construction of the final product. The T-slide member, comprising a bottom member 11 and a top adjusting member 10, is used to establish the location of the base member 1 in relation to position locks 5, 6, 7, 8 and to aid in the positioning of guide rails 3 and 4 when needed after it has been removed from the table. The top adjusting member 10 is attached to the bottom member 11 by a locking screw 9. The adjustment member 10 comprises a slot therein to allow it to be adjusted relative to the bottom member 11. The bottom member 11 is constructed such that it has a top portion 11*a* and a bottom portion 11*b*. The bottom portion 11*b* is constructed to fit within the aperture 13 of the base 1 and the top portion 11*a* is designed to fit within the groove 12 of base member 1. Each of the position locks 5, 6, 7, and 8 has sawdust kerfs cut into one side thereof. The kerfs are cut along the edge that contacts base 1 and is on the side adjacent to the table. The sawdust kerfs are illustrated as 5*a* and 5*b*, 6*a* and 6*b*, 7*a* and 7*b*, 8*a* and 8*b* on each of the position locks 5, 6, 7, and 8, respectively, as shown in FIG. 5. Each of the position locks contains a slot running substantially the full length thereof and is made to accept a locking screw 9. The slot allows the position locks to be moved relative to the table T to position the base 1 relative to the table T and the material stock being held by the table T and worked on by the carpenter.

The following is a description of the preferred embodiment of the present invention in use. Ordinarily and a standard within the industry, whether one is making mortise and tenon or dovetail and socket joinery the male member is made first. That is the tenons or tail respectively. To make then a tenon, a piece of wood stock is located such that the edge to have a tenon placed thereon is located flush with the tabletop. Base 1 is then located over the wood stock such that the aperture 13 is located above the stock relative to the desired left and right position of base member one and then locked into position by locking members 5,6,7 and 8. The edge of the tenon stock nearest the operator and adjacent to radius 14 is located, such that, the operator has determined, that once milled it shall yield the desired shape and size tenon end as suits his application. With base member 1 and the tenon stock each locked in the desired position, slide member 2 is inserted into the groove 12 with the semi-circular end facing the operator and locked into position to establish the length of travel of a router which will be used to mill the tenon in the wood stock. Once the slide member 2 is in place, it is locked into position by a locking screw 9. Once all members are locked into position a woodworker is now ready to utilize the present jig to make the appropriate cut. As is well known to those of ordinary skill in the art, all routers require a bit to be inserted therein and all routers have integral therewith a guide, template, or a guide template, as referred to herein. A woodworker utilizing a router equipped with the appropriate bit would locate the guide template within aperture 13, turn the router on and allow the guide template to follow the contour of aperture 13 and the semi-circular portion of 14 and the semi-circular edge of slide member 2 traveling in a clockwise rotation.

Having completed one full clockwise rotation and having obtained the desired depth of cut, the router is turned off and allowed to come to a complete stop and then removed from base member 1. The tenon is complete.

If the operator were making a tail member for a sliding dovetail joint he would do so in substantially the same manner as when making a tenon. However, he would not use slide member 2 when doing so. Given that both the stock to be milled and base member 1 have each been locked in the desired position, the operator would begin by placing the router equipped with the appropriate bit and guide template such that the guide template would be in contact with the contour of aperture 13 furthest from himself and at the right hand side of aperture 13. He would then turn the router on and beginning with the right hand edge of aperture 13 proceeding in a clockwise rotation the guide template would follow the contour of aperture 13 toward himself around the semi-circular portion of 14 thence away from himself along the left contour of aperture 13 until he exits the stock being milled. The router is then turned off, allowed to come to a complete stop and removed from base member 1. The tail member is thus complete.

It should be noted that slide member 2 may have a scale placed thereon to allow the operator to determine the size of the joint he is placing on the wood.

Once the tenon or tail has been made in the wood stock, the carpenter can do one of many options. If the joint is to be a double tenon or double tail joint, then the locking members 5, 6, 7, and 8 are released by loosening the lock screws 9 allowing the base member 1 to then be slid right or left relative to the wood stock locating the aperture 13 over a newly desired position.

For ease of explanation, it will be assumed that viewing FIG. 1, the procedure would be to loosen locking screws 9 that hold locking members 5 and 6 into place, 5 and 6 are slid to the right as shown in the figure, to the new location and then locked into position by locking screws 9. Base member 1 is then slid to the right against the locking members 5 and 6. Prior to loosening the locking screws that hold locking member 7 and 8 into place, the sliding T member is now utilized. The base or slide member 11 is inserted into the aperture 13 and groove 12, the top member 10 is then placed on top of the member 11 and held into position by a locking screw 9. The slide member 11 is slid in the aperture 13 first, so that the top member is aligned with locking member 7. Once that is done, such that a top member 10 is in engagement with locking member 7, the locking screw 9 is then tightened so as to lock members 10 and 11 together. The T member is then slid in the opposite direction so that top member 10 engages locking member 8 to ensure that an equal distance is maintained to the stops 7 and 8. Once this is done, the T member is removed from base member 1, locking screws 9 is loosened to allow locking member 7 and 8 to be slid to the right and once again re-engage base 1. Once this has been done, the second tenon can now be installed on the stock member in the same manner as was done for the first tenon.

Once the operator has made all of the tenons or tails he desires to make, locking members 5, 6, 7 and 8 are loosened so that base member 1 can be repositioned to begin making the matching mortises or sockets. To make then the matching mortises a new piece of wood stock is located in the table such that the edge to have a mortise milled therein is flush with the tabletop. Base member 1 is again located on top of the table such that aperture 13 is over the wood stock. With base member 1 positioned left and right in relation to the stock to be milled locking members 5, 6,7, and 8 are again brought into contact with base member 1 and locked into position using locking screws 9. Slide member 2 is then inserted in groove 12 with the square end facing the operator. Once the length of travel has been determined to match that of the previously made tenons slide member 2 is locked into position by locking screw 9. The operator then turns on the router equipped with the appropriate bit and guide template and places the guide template against the contour of aperture 13 nearest himself and to his left. He plunges the bit to the desired depth of cut and proceeds to allow the guide template to follow the contour of aperture 13 away from himself until the guide template comes in contact with the square edge of slide member 2. Since multiple passes of the router are needed when making mortises he then returns the router to its initial position, plunges the bit deeper and repeats the same operation. Once the desired depth of cut has been obtained he turns off the router, allows it to come to a complete stop and removes the router from base 1.

If one were making dovetail sockets to match his previously made tails he would do so in substantially the same manner as when making mortises. However, he may find it necessary to utilize guide rail 4 in order to obtain the desired width of cut. This is done by inserting guide rail 4 such that slots 4A and 4B are located over the threaded holes in base 1. Once the desired width of cut has been determined guide rail 4 is then locked in place by locking screws 9. With the edge of the stock to be milled then flush with the tabletop and the end of the stock nearest the operator at least one inch away from radius 14, as radius 14 is not used when making sockets, slide member 2 is inserted into groove 12 with the square end facing the operator. Once the desired length of travel has been determined to match that of his previously made tails slide member 2 is then locked into position using locking screw 9. With the appropriate bit and guide template installed in the router the user places the router on base member 1 so that his guide template is in contact with the contour of aperture 13 nearest himself and to his left. The router is turned on and the guide template is allowed to follow the left contour of aperture 13 away from himself in a clockwise rotation along aperture 13 till his guide template comes into contact with the square edge of slide 2, then he moves to the right until the router base comes into contact with guide rail 4 and then proceeds to allow the router base to follow guide rail 4 back toward himself until he reaches the end of aperture 13 at radius 14. The socket is thus complete. The router is turned off, allowed to come to a complete stop and removed from base 1.

Once the mortise or socket has been made, the router is removed from the base member 1. For a double joint a second mortise or socket will need to be cut to match the other tenon/tail as was cut on the previous piece of stock. This is done by loosening locking screws 9 holding locking member 5 and 6 in place. Locking members 5 and 6 are then slid to the right, as is base member 1. T member 10 and 11 are then utilized to locate locking members 5 and 6. This is done by placing the lower member 11 into the aperture 13 and groove 12 and having the top portion 10 engage locking member 7 and once locking member 6 is correctly positioned the locking screw 9 is tightened holding it in place. The T member is then slid such that the top member 10 engages locking member 8 and once locking member 5 is located the locking screw 9 is tightened to hold it in place. With this done, the T member is removed. Locking members 7 and 8 are then slid to the right after loosening the locking screws 9 until they engage the base 1. Once they engage base 1, the locking screws are again tightened thus holding locking members 7 and 8 in place and firmly holding base member 1 in position. A carpenter will then use the router as described above to cut the second mortise or socket joint. Once this has been done, the jig member can be removed and the wood stock removed thereafter, thus now providing a double mortise and tenon joint with substantially a perfect fit every time.

If a single mortise and tenon or dovetail and socket joint is desired, one would operate in much the same manner, however, simply not sliding base member 1 to the right or left in a position to cut the second mortise and tenon. With relative ease and simplicity of operation, the present invention allows for the production of nearly perfect mortise and tenon and sliding dovetail joints every time whether they are single or double joints. It is believed that all prior art fails to provide a device that can make both double sliding dovetail and double mortise and tenon joints and, if in fact, there is a device that can produce double mortise and tenon and double sliding dovetail joints, it cannot be done with the ease of operation and the precision that is capable with utilizing the present invention.

Figure 2:
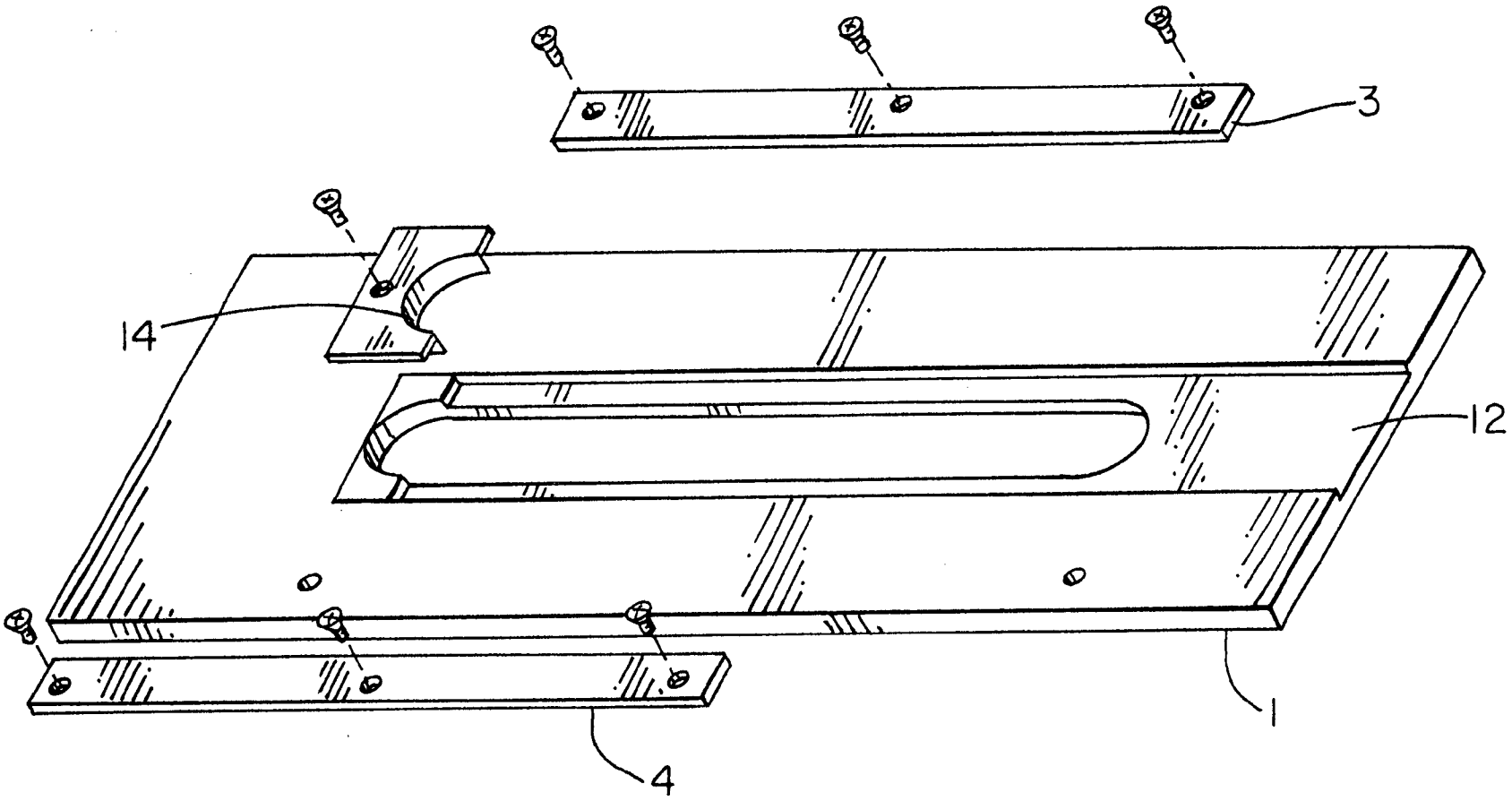
FIG. 2 is a partial view of the invention showing the base with a removable radius and guide members.
Figure 3:
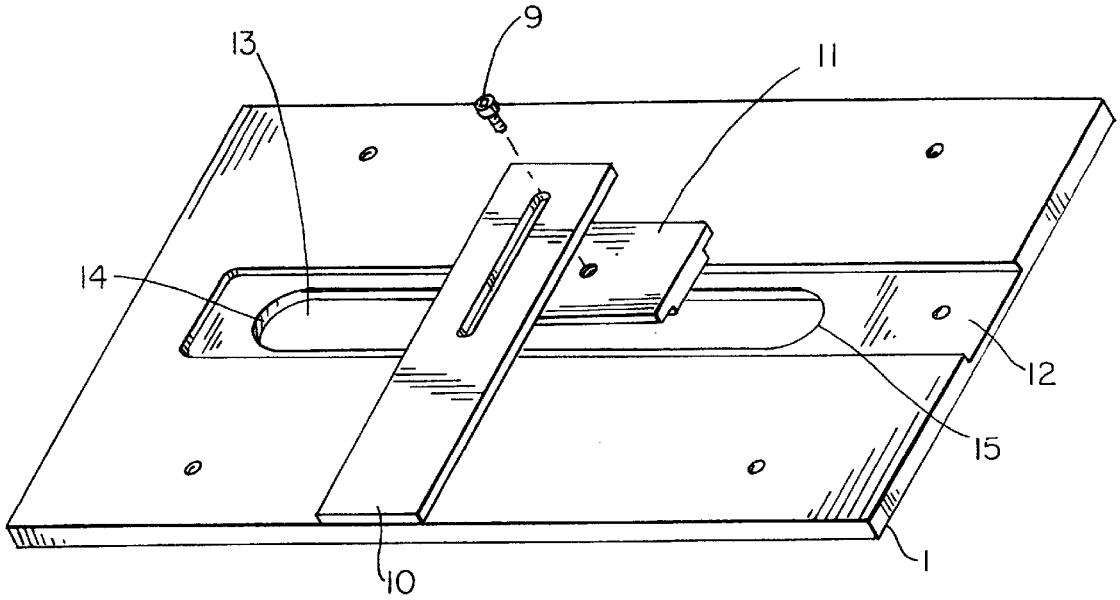
FIG. 3 is a partial view showing the T-slide and base.
Figure 4:
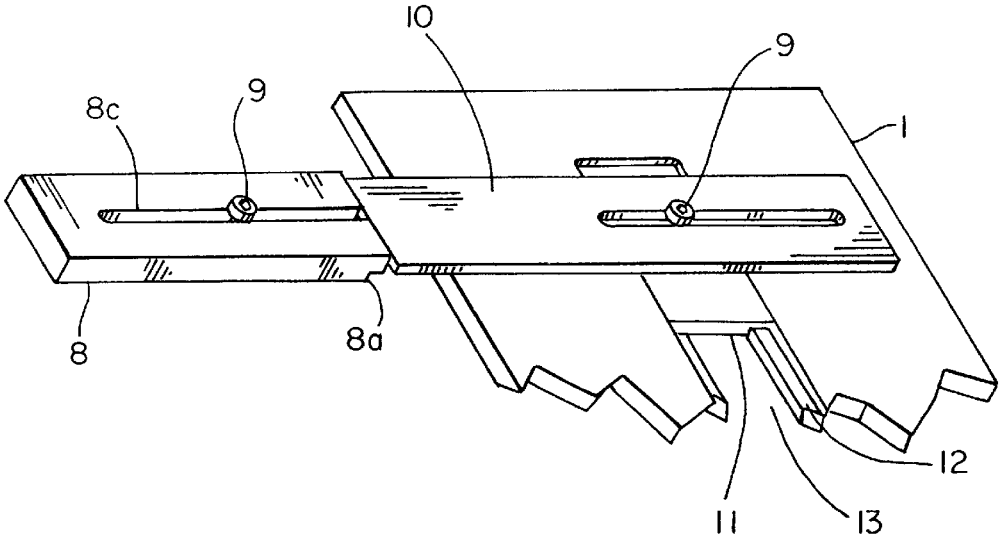
FIG. 4 is a partial view showing the T-slide engaged with a position lock.

FIG. 2 shows the invention with a slight variation. The radius 14 is removable from the base 1, thus allowing for any number of sizes of radius to be utilized. Also, removable router guides 3 and 4 are shown and these are sized to accommodate the removable radius 14. These guides allow the router template to ride against them rather than the router base as shown in FIG. 1.

While the preferred embodiment has been disclosed and discussed at detail, various modifications can occur and would be obvious to one of ordinary skill in the art. Such modifications would be that the pieces and the elements making up the present invention could be made from a variety of materials. The preferred embodiment would be that all materials and elements would be made from extruded aluminum. However, they could be made from wood, plastic or some other composite material. Also, a scale as previously mentioned could be placed on the sliding element 2 to allow for precise measurement time and again when sliding the element in and out of the groove 12 relative to base member 1. This scale could be fixedly mounted or installed onto the element 2 or it could be of a design that would make it readily removable such that various scales could be placed thereon, for example either metric or SAE measurements could be utilized interchangeably.

What is claimed is:

1. A jig means for construction of mortise and tenon and sliding dovetail joints on stock members, comprising:

a base member having an aperture and a groove contained therein;

a slide member, located on the base member, and containing a semi-circular portion, a square portion, and an aperture therein;

plural locking members adjacent to said base member;

a guide means attachable to said base member; and plural locking means for locking said guide means, said slide member and said locking members relative to said base member.

2. A jig means as previously recited in claim 1 further comprising the aperture in the base member is contained within the groove of the base member.

3. A jig means as recited in claim 1 further comprising the slide member located in the groove of the base member and moveable relative to the base member and adapted to be fixedly attached thereto.

4. A jig means as previously recited in claim 1 further comprising the guide means comprising two guide rails located on the base member such that they can be moved relative to each other and the base member and capable of being fixedly attached to the base member.

5. A jig means as previously recited in claim 1 further comprising the locking members comprising four locking members moveable relative to the base member and engagable therewith; and the locking members when engaged with the base member will fixedly hold the base member in a fixed position.

* * * * *